US011964679B2

(12) United States Patent
Liang et al.

(10) Patent No.: US 11,964,679 B2
(45) Date of Patent: Apr. 23, 2024

(54) UNDERFRAME END STRUCTURE WITHOUT BOLSTER BEAM FOR RAIL VEHICLE

(71) Applicant: CRRC Nanjing Puzhen Co., Ltd., Nanjing (CN)

(72) Inventors: Juxing Liang, Nanjing (CN); Xingwen Wang, Nanjing (CN); Yunchuan Li, Nanjing (CN); Yongjun Li, Nanjing (CN); Wenjie Huang, Nanjing (CN); Changping Zhu, Nanjing (CN)

(73) Assignee: CRRC Nanjing Puzhen Co., Ltd., Nanjing (CN)

( * ) Notice: Subject to any disclaimer, the term of this patent is extended or adjusted under 35 U.S.C. 154(b) by 874 days.

(21) Appl. No.: 17/044,235

(22) PCT Filed: Sep. 30, 2019

(86) PCT No.: PCT/CN2019/109338
§ 371 (c)(1),
(2) Date: Sep. 30, 2020

(87) PCT Pub. No.: WO2021/035874
PCT Pub. Date: Mar. 4, 2021

(65) Prior Publication Data

US 2023/0109547 A1 Apr. 6, 2023

(30) Foreign Application Priority Data

Aug. 30, 2019 (CN) ..... 201910813790.8

(51) Int. Cl.
*B61F 1/10* (2006.01)

(52) U.S. Cl.
CPC ..... *B61F 1/10* (2013.01)

(58) Field of Classification Search
CPC ..... B61F 1/00; B61F 1/04; B61F 1/06; B61F 1/08; B61F 1/10; B61F 1/14
See application file for complete search history.

(56) References Cited

FOREIGN PATENT DOCUMENTS

| | | | | |
|---|---|---|---|---|
| CN | 103832446 A | | 6/2014 | |
| CN | 104149806 A | | 11/2014 | |
| CN | 106004911 A | * | 10/2016 | ..... B61F 1/00 |
| CN | 106004911 A | | 10/2016 | |
| CN | 107901938 A | * | 4/2018 | ..... B61F 1/08 |
| CN | 107901938 A | | 4/2018 | |

(Continued)

*Primary Examiner* — Robert J McCarry, Jr.
(74) *Attorney, Agent, or Firm* — Bayramoglu Law Offices LLC

(57) ABSTRACT

An underframe end structure without a bolster beam for a rail vehicle, including an underframe end beam, an underframe edge beam, a coupler mounting base, coupler support beams, and oblique support beams, where the front of the coupler mounting base is connected to the underframe end beam through the oblique support beams, two sides of the coupler mounting base are connected to the underframe edge beam through the coupler support beams, so that quadrilateral frame structures are respectively formed on the two sides of the coupler mounting base, the oblique support beams form an included angle of 55° to 80° with a forward opening, and the coupler support beams form an included angle of 120° to 140° with a backward opening.

12 Claims, 2 Drawing Sheets

(56) References Cited

FOREIGN PATENT DOCUMENTS

| | | | |
|---|---|---|---|
| CN | 110155097 | A | 8/2019 |
| CN | 110696864 | A | 1/2020 |
| EP | 0689982 | A1 | 1/1996 |

* cited by examiner

UNDERFRAME END STRUCTURE WITHOUT BOLSTER BEAM FOR RAIL VEHICLE

CROSS REFERENCE TO RELATED APPLICATION

This application is the national stage entry of International Application No. PCT/CN2019/109338, filed on Sep. 30, 2019, which is based upon and claims priority to Chinese Patent Application No. 201910813790.8, filed on Aug. 30, 2019, the entire contents of which are incorporated herein by reference.

TECHNICAL FIELD

The present invention relates to an underframe end structure without a bolster beam for a rail vehicle, is particularly adapted to a subway vehicle bearing a high longitudinal force, and belongs to the technical field of vehicle body structure design for rail vehicles.

BACKGROUND

With the development of rail vehicle technologies, requirements on vehicles are increasingly high. Not only convenient vehicle body structure assembly and proper installation interfaces for devices are required, but also requirements, such as a capacity of bearing a high longitudinal force, need to be satisfied.

Currently, ends of rail vehicle underframes are mainly end structures with a bolster beam and end structures without a bolster beam. There are many assembly relationships between an end structure with a bolster beam and a bogie, and process adjustment is complex. There are a small quantity of structures without a bolster beam, which have technical problems, such as a low bearing capacity and a severe stress concentration problem, due to an undiversified longitudinal force transmission path.

It is found through searches that Chinese invention patent application CN106004911A relates to an end structure without a bolster beam, using a front box structure for bearing. Main technical features thereof are reducing installation interfaces of a bogie and reducing processes and installation. The structure is borne on the front box, and because of an undiversified force transmission structure, the structure is likely to form stress concentration and has a bearing capacity that is not high. The box structure of the front greatly affects an installation space and a motion space of a coupler.

SUMMARY

For the foregoing problems in the prior art, an objective of the present invention is to provide an underframe end structure without a bolster beam for a rail vehicle, in which a longitudinal force on a vehicle is transmitted through multiple paths, to ensure a bearing capacity of the structure.

To resolve the foregoing technical problems, the present invention provides an underframe end structure without a bolster beam for a rail vehicle, including an underframe end beam, an underframe edge beam, a coupler mounting base, and coupler support beams, and further including: oblique support beams, where the front of the coupler mounting base is connected to the underframe end beam through the oblique support beams, two sides of the coupler mounting base are connected to the underframe edge beam through the coupler support beams, so that quadrilateral frame structures are respectively formed on the two sides of the coupler mounting base, the oblique support beams form an included angle of 55° to 80° with a forward opening, and the coupler support beams form an included angle of 120° to 140° with a backward opening.

Further, the included angle between the oblique support beams preferably ranges from 62° to 68°.

The present invention further sets forth a rail vehicle, including the foregoing underframe end structure without a bolster beam for a rail vehicle.

A production process for the underframe end structure without a bolster beam for a rail vehicle is provided, including the following steps:

step 1: welding a coupler mounting base, coupler support beams, and oblique support beams to form a main frame, where an included angle of 55° to 80° with a forward opening is formed between the coupler support beams, and an included angle of 120° to 140° with a backward opening is formed between the oblique support beams;

step 2: welding a coupler connecting base to the rear of the coupler mounting base, and welding a traction beam to the rear of the coupler connecting base, to form an end bearing structure;

step 3: welding an underframe end beam, an underframe edge beam, and an underframe floor to form an entire structure; and step 4: welding the end bearing structure to the entire structure, specifically including: welding the front end of the oblique support beam to the underframe end beam, welding the outer end of the coupler support beam to the underframe edge beam, and welding the end bearing structure to the bottom face of the underframe floor, to form an entire end structure without a bolster beam.

Beneficial effects of the present invention are as follows:

1. All components can be produced independently and then be assembled, so that production efficiency can be improved.
2. A longitudinal force on a vehicle can be transmitted through multiple paths, to disperse transmission of a longitudinal force through a single path, thereby ensuring a bearing capacity of the structure. A stress concentration region is processed by using a transition structure, to satisfy a fatigue life requirement of the structure.
3. A structure without a bolster beam is used to avoid a complex assembly relationship with a bogie and process adjustment.

DETAILED DESCRIPTION OF THE EMBODIMENTS

Implementations of the present invention are explained and descried below with reference to the accompanying drawings.

Figure 1:
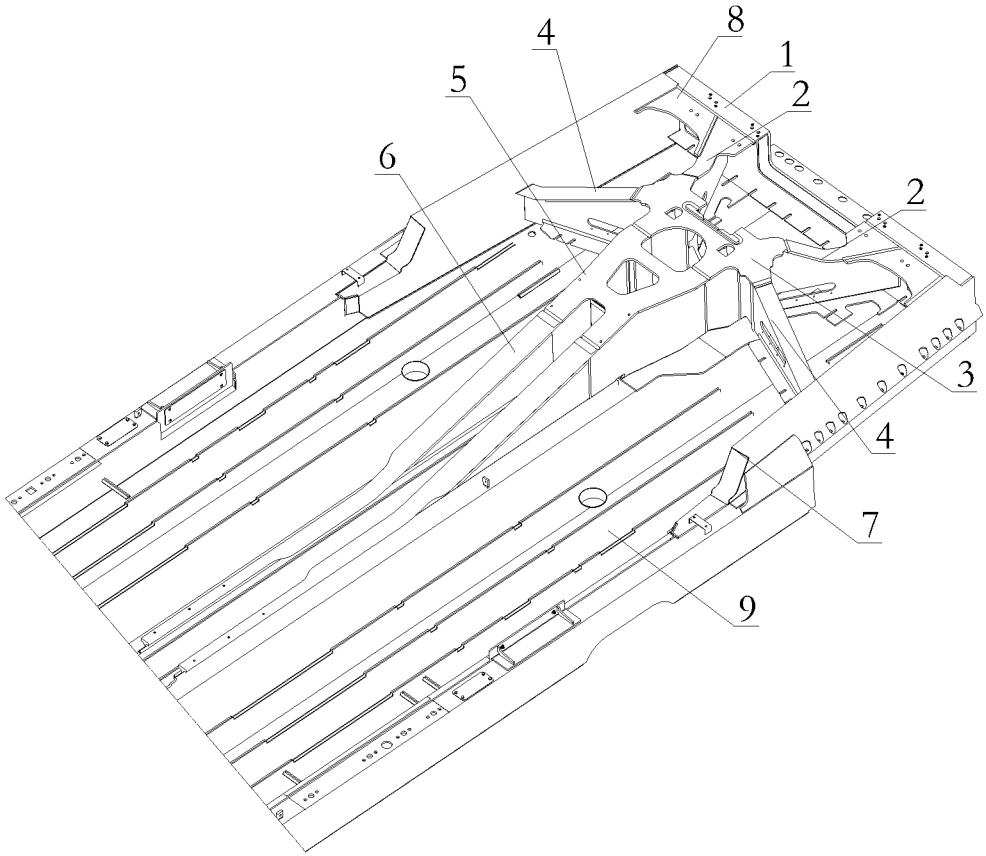
FIG. 1 is a three-dimensional diagram of an underframe end structure without a bolster beam for a rail vehicle according to the present invention.
Figure 2:
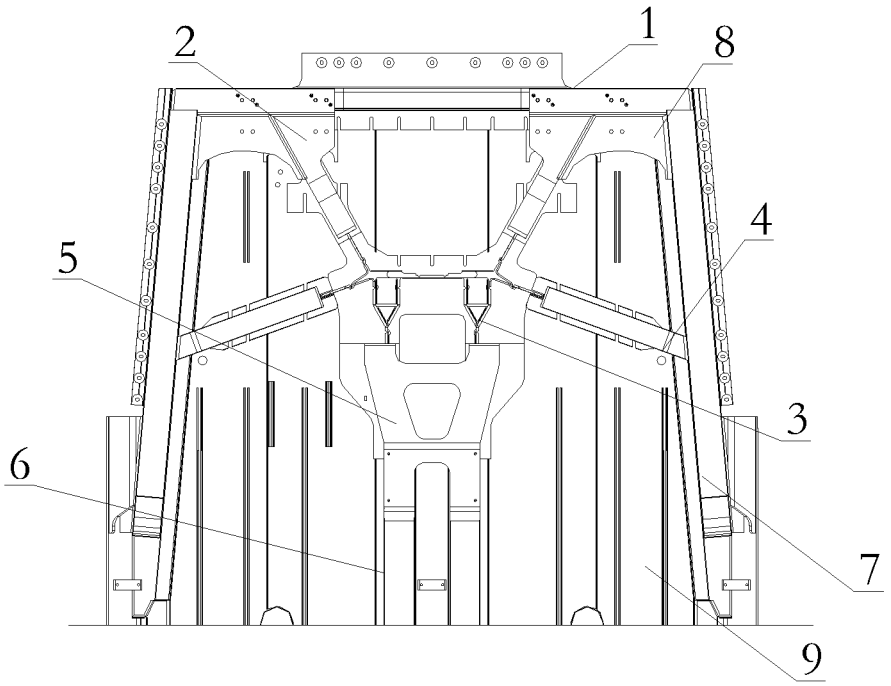
FIG. 2 is a bottom view of an underframe end structure without a bolster beam for a rail vehicle according to the present invention.
Figure 3:
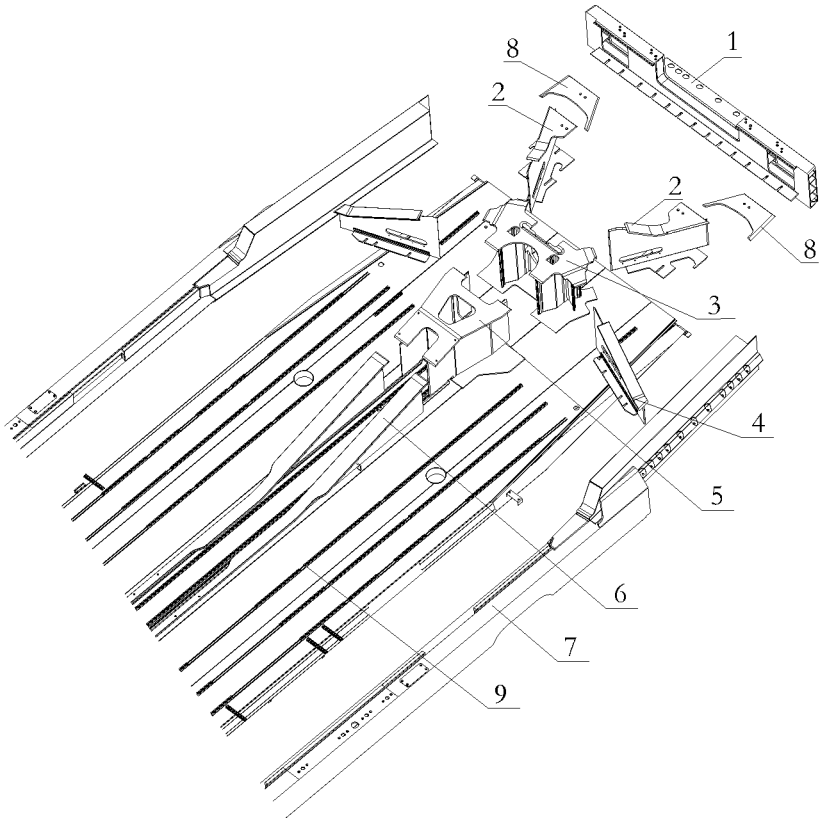
FIG. 3 is an exploded view of an underframe end structure without a bolster beam for a rail vehicle according to the present invention.

As shown in FIG. 1, FIG. 2, and FIG. 3, in this embodiment, an underframe end structure without a bolster beam for a rail vehicle includes an underframe end beam 1, an underframe edge beam 7, an underframe floor 9, a coupler mounting base 3, two oblique support beams 2, two coupler support beams 4, a coupler connecting base 5, a traction beam 6, and a front-end connecting plate 8, as shown in FIG. 1. All components are separately welded or separately processed, and then are assembled in a welded manner. The coupler mounting base 3, the oblique support beams 2, the two coupler support beams 4, the coupler connecting base 5, and the traction beam 6 are welded to the bottom face (the lower surface) of an underframe floor 9.

The front of the coupler mounting base 3 is connected to the underframe end beam 1 through the oblique support beams 2, two sides of the coupler mounting base 3 are connected to the underframe edge beam 7 through the coupler support beams 4, to form a main frame, so that quadrilateral frame structures are respectively formed on the two sides of the coupler mounting base 3, to help transmission of a force. The two oblique support beams 2 form an included angle of 65° with a forward opening (the included angle between the oblique support beams ranges from 55° to 80°, preferably from 62° to 68°), the two coupler support beams 4 form an included angle of 130° with a backward opening (the included angle between the coupler support beams relatively properly ranges from 120° to 140°). The oblique support beams 2 are connected to the underframe edge beam 7 through the front-end connecting plate 8, so that a force transmission area of the vehicle is enlarged when the vehicle bears a force. In addition, this connection does not affect an anti-climbing device or a lead-up space.

The two oblique support beams 2 are connected to the coupler mounting base 3 to form a specific angle, which is adjustable according to a swing space of a coupler, to powerfully ensure a motion space and an installation space of the coupler. The coupler mounting base 3 is connected to a plate through a profile. An interface of the coupler is directly extruded from the profile to avoid welding. The extruded profile is in a "Y-shaped" structure, which is beneficial to transmission of a longitudinal force. As shown in FIG. 2, the coupler connecting base 5 is disposed behind the coupler mounting base 3, and the coupler connecting base 5 is connected by using a plate, to form a gentle frame connecting structure, which is beneficial to bearing of a longitudinal force. A baffle inside the coupler mounting base 3 is provided with a hole, to ensure a decoupling space of the coupler during a collision of a vehicle, and also prevent the coupler from falling into a track and causing secondary disasters.

The front end of the traction beam 6 is welded to the coupler connecting base 5, and the traction beam 6 is connected to the underframe floor 9, and is transitioned to the underframe floor 9 through a connecting plate, so that a force that is borne is transmitted to the underframe floor, and the entire structure is used for bearing. The traction beam 6 can extend into a bolster beam according to a force bearing status, to enhance transmission of a force.

All of the foregoing structures are made of alloy material, and this solution is applicable to structural design of two-position ends of a locomotive.

A production process of the underframe end structure without a corbel beam for a rail vehicle in this embodiment includes the following steps:

Step 1: Weld a coupler mounting base 3, coupler support beams 4, and oblique support beams 2 to form a main frame, where an included angle of 55° to 80° with a forward opening is formed between the coupler support beams 4, and an included angle of 120° to 140° with a backward opening is formed between the oblique support beams 2.

Step 2: Weld a coupler connecting base 5 to the rear of the coupler mounting base 3, and weld a traction beam 6 to the rear of the coupler connecting base 5, to form an end bearing structure.

Step 3: Weld an underframe end beam 1, an underframe edge beam 7, and an underframe floor 9 to form an entire structure.

Step 4: Weld the end bearing structure to the entire structure, specifically including: welding the front end of the oblique support beam 2 to the underframe end beam 1, welding the outer end of the coupler support beam 4 to the underframe edge beam 7, and welding the end bearing structure to the bottom face of the underframe floor 9, to form an entire end structure without a bolster beam.

At this point, assembly of the entire underframe end structure without a bolster beam is completed.

In addition to the foregoing embodiments, the present invention may further include other implementations. Any technical solution formed through equivalent replacement or equivalent transformation falls within the protection scope claimed in the present invention.

What is claimed is:

1. An underframe end structure without a bolster beam for a rail vehicle, comprising an underframe end beam, an underframe edge beam, a coupler mounting base, coupler support beams, and oblique support beams, wherein a front of the coupler mounting base is connected to the underframe end beam through the oblique support beams, two sides of the coupler mounting base are connected to the underframe edge beam through the coupler support beams to form quadrilateral frame structures on the two sides of the coupler mounting base, respectively, the oblique support beams form an included angle of 55° to 80° with a forward opening, and the coupler support beams form an included angle of 120° to 140° with a backward opening, wherein a front of an oblique support beam of the oblique support beams is connected to the underframe edge beam through a front-end connecting plate on an outer side of the front of the oblique support beam.

2. The underframe end structure without the bolster beam for the rail vehicle according to claim 1, wherein the coupler mounting base, the coupler support beams, and the oblique support beams are welded to form a main frame.

3. The underframe end structure without the bolster beam for the rail vehicle according to claim 1, wherein the coupler mounting base is formed by connecting a profile and a plate, and a baffle inside the coupler mounting base is provided with a hole; and the coupler connecting base is formed by connecting plates, to form a frame structure.

4. A rail vehicle, comprising the underframe end structure without the bolster beam for the rail vehicle according to claim 1.

5. The rail vehicle according to claim 4, wherein the coupler mounting base, the coupler support beams, and the oblique support beams are welded to form a main frame.

6. The rail vehicle according to claim 4, wherein the coupler mounting base is formed by connecting a profile and a plate, and a baffle inside the coupler mounting base is provided with a hole; and the coupler connecting base is formed by connecting plates, to form a frame structure.

7. An underframe end structure without a bolster beam for a rail vehicle, comprising an underframe end beam, an underframe edge beam, a coupler mounting base, coupler support beams, and oblique support beams, wherein a front of the coupler mounting base is connected to the underframe end beam through the oblique support beams, two sides of the coupler mounting base are connected to the underframe edge beam through the coupler support beams to form quadrilateral frame structures on the two sides of the coupler mounting base, respectively, the oblique support beams form an included angle of 55° to 80° with a forward opening, and the coupler support beams form an included angle of 120° to 140° with a backward opening, said underframe end structure further comprising a coupler connecting base and a traction beam, wherein the coupler connecting base is located behind the coupler mounting base, and the traction beam is located behind the coupler connecting base.

8. The underframe end structure without the bolster beam for the rail vehicle according to claim 7, further comprising an underframe floor, wherein the coupler mounting base, the coupler support beams, the oblique support beams, the coupler connecting base, and the traction beam are welded to a lower surface of the underframe floor.

9. The underframe end structure without the bolster beam for the rail vehicle according to claim 7, wherein two ends of an oblique support beam of the oblique support beams are respectively welded to the coupler mounting base and the underframe end beam, two ends of a coupler support beam of the coupler support beams are respectively welded to the coupler mounting base and the underframe edge beam, and a front and rear ends of the coupler connecting base are respectively welded to the coupler mounting base and the traction beam.

10. A rail vehicle, comprising an underframe end structure without a bolster beam for the rail vehicle, said underframe end structure including an underframe end beam, an underframe edge beam, a coupler mounting base, coupler support beams, and oblique support beams, wherein a front of the coupler mounting base is connected to the underframe end beam through the oblique support beams, two sides of the coupler mounting base are connected to the underframe edge beam through the coupler support beams to form quadrilateral frame structures on the two sides of the coupler mounting base, respectively, the oblique support beams form an included angle of 55° to 80° with a forward opening, and the coupler support beams form an included angle of 120° to 140° with a backward opening, said underframe end structure further comprising a coupler connecting base and a traction beam, wherein the coupler connecting base is located behind the coupler mounting base, and the traction beam is located behind the coupler connecting base.

11. The rail vehicle according to claim 10, further comprising an underframe floor, wherein the coupler mounting base, the coupler support beams, the oblique support beams, the coupler connecting base, and the traction beam are welded to a lower surface of the underframe floor.

12. The rail vehicle according to claim 10, wherein two ends of an oblique support beam of the oblique support beams are respectively welded to the coupler mounting base and the underframe end beam, two ends of a coupler support beam of the coupler support beams are respectively welded to the coupler mounting base and the underframe edge beam, and a front and rear ends of the coupler connecting base are respectively welded to the coupler mounting base and the traction beam.

* * * * *